US010649388B2

(12) United States Patent
Yoshida et al.

(10) Patent No.: US 10,649,388 B2
(45) Date of Patent: May 12, 2020

(54) IMAGE FORMING APPARATUS

(71) Applicant: CANON KABUSHIKI KAISHA, Tokyo (JP)

(72) Inventors: Tsuguhiro Yoshida, Yokohama (JP); Shinji Katagiri, Yokohama (JP); Takayuki Tanaka, Tokyo (JP); Shuichi Tetsuno, Kawasaki (JP); Takahiro Ikeda, Oyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 209 days.

(21) Appl. No.: 15/847,726

(22) Filed: Dec. 19, 2017

(65) Prior Publication Data

US 2018/0181051 A1 Jun. 28, 2018

(30) Foreign Application Priority Data

Dec. 26, 2016 (JP) ..... 2016-251837

(51) Int. Cl.
*G03G 15/16* (2006.01)
*G03G 15/00* (2006.01)

(52) U.S. Cl.
CPC ..... *G03G 15/80* (2013.01); *G03G 15/161* (2013.01); *G03G 2215/1661* (2013.01)

(58) Field of Classification Search
CPC ..... G03G 15/80; G03G 15/161; G03G 2215/1661
See application file for complete search history.

(56) References Cited

U.S. PATENT DOCUMENTS 5,983,060 A * 11/1999 Namekata ..... G03G 15/161 399/297
6,212,351 B1 * 4/2001 Kawagoe ..... G03G 15/161 399/302
6,269,228 B1 * 7/2001 Kayahara ..... G03G 15/161 399/302
6,970,675 B1 * 11/2005 Yoshino ..... G03G 15/161 399/307
2001/0028817 A1 * 10/2001 Tamura ..... G03G 15/0131 399/297
2001/0053298 A1 * 12/2001 Fujishiro ..... G03G 15/0208 399/159
2002/0051659 A1 * 5/2002 Baba ..... G03G 15/161 399/307
2003/0007806 A1 * 1/2003 Kayahara ..... G03G 15/161 399/129
2003/0016968 A1 * 1/2003 Takahashi ..... G03G 15/161 399/297

(Continued)

FOREIGN PATENT DOCUMENTS

JP 10-319734 A 12/1998
JP 2010-145901 A 7/2010
JP 2012-098709 A 5/2012

*Primary Examiner* — David J Bolduc
(74) *Attorney, Agent, or Firm* — Canon U.S.A., Inc. IP Division

(57) ABSTRACT

An intermediate transfer belt includes at least two layers which are a base layer and an inner surface layer having electric resistance lower than electric resistance of the base layer, and an end portion of the inner surface layer is positioned on an outside of an end portion of a development opening portion in a width direction as a direction orthogonal to a circumferential direction of the intermediate transfer belt.

17 Claims, 9 Drawing Sheets

(56) References Cited

U.S. PATENT DOCUMENTS

2003/0016969 A1* 1/2003 Sawai ..... G03G 15/161 399/297
2003/0063930 A1* 4/2003 Kiuchi ..... G03G 15/161 399/307
2003/0147678 A1* 8/2003 Ozawa ..... G03G 15/1605 399/302
2004/0013863 A1* 1/2004 Terakawa ..... B32B 7/02 428/212
2005/0095029 A1* 5/2005 Kitamura ..... G03G 15/168 399/102
2006/0034639 A1* 2/2006 Kamijo ..... G03G 15/10 399/237
2006/0083527 A1* 4/2006 Sakamaki ..... G03G 15/0121 399/50
2006/0285871 A1* 12/2006 Kato ..... G03G 15/168 399/99
2007/0003319 A1* 1/2007 Nakaya ..... G03G 15/1605 399/102
2007/0036569 A1* 2/2007 Taguchi ..... G03G 15/161 399/49
2007/0098449 A1* 5/2007 Kadota ..... G03G 15/0848 399/254
2007/0201897 A1* 8/2007 Maeda ..... G03G 15/161 399/101
2007/0264049 A1* 11/2007 Kamoshida ..... G03G 15/0208 399/168
2008/0138121 A1* 6/2008 Tamaki ..... G03G 15/161 399/302
2009/0041508 A1* 2/2009 Oshikawa ..... G03G 15/0844 399/254
2009/0129810 A1* 5/2009 Kobashi ..... G03G 15/161 399/101
2009/0185818 A1* 7/2009 Saka ..... G03G 15/11 399/101
2009/0208240 A1* 8/2009 Saka ..... G03G 15/161 399/101
2010/0092222 A1* 4/2010 Chiba ..... G03G 15/0131 399/350
2010/0303498 A1* 12/2010 Takazawa ..... G03G 15/161 399/101
2011/0076053 A1* 3/2011 Kadota ..... G03G 15/161 399/101
2011/0097104 A1* 4/2011 Sueoka ..... G03G 15/161 399/101
2011/0116829 A1* 5/2011 Takayanagi ..... G03G 15/161 399/101
2012/0315067 A1* 12/2012 Takahashi ..... G03G 15/162 399/302
2012/0315071 A1* 12/2012 Saito ..... G03G 15/0189 399/346
2013/0077989 A1* 3/2013 Saito ..... G03G 15/161 399/101
2013/0188980 A1* 7/2013 Ito ..... G03G 15/80 399/88
2013/0188981 A1* 7/2013 Horiguchi ..... G03G 15/1605 399/88
2013/0195519 A1* 8/2013 Ito ..... G03G 15/1675 399/314
2014/0321891 A1* 10/2014 Karashima ..... G03G 15/0189 399/314
2014/0356030 A1* 12/2014 Fukuda ..... G03G 15/09 399/267
2015/0003880 A1* 1/2015 Ohno ..... G03G 15/80 399/302
2015/0177650 A1* 6/2015 Shoji ..... G03G 15/0898 399/103
2015/0338783 A1* 11/2015 Matsushita ..... G03G 15/1685 399/299
2015/0338791 A1* 11/2015 Matsushita ..... G03G 15/1615 399/66
2016/0070194 A1* 3/2016 Karashima ..... G03G 15/0189 399/89
2018/0039198 A1* 2/2018 Saito ..... G03G 15/0121
2018/0143570 A1* 5/2018 Mizutani ..... G03G 15/161
2018/0157195 A1* 6/2018 Iida ..... G03G 15/161

* cited by examiner

IMAGE FORMING APPARATUS

BACKGROUND OF THE INVENTION

Field of the Invention

The present disclosure relates to an electrophotographic image forming apparatus, such as a copying machine or a printer.

Description of the Related Art

Conventionally, there has been known an electrophotographic-type color image forming apparatus which sequentially transfers toner images to an intermediate transfer member from image forming units of respective colors and collectively transfers the toner images to a transfer material from the intermediate transfer member.

In the above-described image forming apparatus, each of the image forming units includes a drum-shape photosensitive member (hereinafter, referred to as "photosensitive drum") serving as an image bearing member. In execution of image forming, after a surface of the photosensitive drum is uniformly charged by a charging member that is in contact with the photosensitive drum and exposed to light according to an image signal by an exposure unit, a toner image is developed on the photosensitive drum by a development unit. The development unit includes a development container for containing toner and a development roller arranged on a development opening portion of the development container, and the development roller that bears toner rotates while abutting on the photosensitive drum, so that a toner image is developed on the photosensitive drum.

Then, voltage is applied to a primary transfer member from a primary transfer power source, so that the toner image formed on the photosensitive drum of each of the image forming units is primarily transferred to the intermediate transfer member. The primary transfer member is arranged to face the photosensitive drum via the intermediate transfer member, such as an intermediate transfer belt. At a secondary transfer portion, voltage is applied to a secondary transfer member from a secondary transfer power source, so that toner images of respective colors which are primarily transferred to the intermediate transfer member from the image forming units of the respective colors are collectively and secondarily transferred to a transfer material such as a sheet or an overhead transparency (OHT) sheet from the intermediate transfer member. Thereafter, the toner image in respective colors transferred to the transfer material is fixed to the transfer material by a fixing unit.

Japanese Patent Application Laid-Open No. 2012-098709 discusses a configuration employing an intermediate transfer belt having electrical conductivity and serving as an intermediate transfer member, in which electric current supplied from an electric current supply member flows in a circumferential direction of the intermediate transfer belt, so that toner images are primarily transferred to the intermediate transfer belt from a plurality of photosensitive drums.

However, in the configuration described in Japanese Patent Application Laid-Open No. 2012-098709, a magnitude relationship between a width of the intermediate transfer belt and a width of the development opening portion of the development unit in a width direction of the intermediate transfer belt has not been described. In the configuration in which primary transfer processing is executed by supplying electric current in a circumferential direction of the intermediate transfer belt, there is a possibility that electric potential for causing the toner image to be transferred to the intermediate transfer belt from the photosensitive drum is formed in the entire region in the width direction of the intermediate transfer belt. If an end portion of the intermediate transfer belt is positioned further inside than an end portion of the development opening portion in the width direction of the intermediate transfer belt, below-described issues may occur.

The development roller is formed to have a width wider than a width of an image forming region, and the photosensitive drum is formed to have a width wider than the width of the development roller in a width direction of the intermediate transfer belt. If toner is borne at a position of the development roller on a side of an end portion of the development opening portion, there is a risk in that the toner may move to the photosensitive drum from an end portion of the development roller (hereinafter, this moving toner is referred to as "end-portion toner"). If the end portion of the intermediate transfer belt is positioned further inside than the end portion of the development opening portion, the end-portion toner that has moved to the photosensitive drum remains in the photosensitive drum without being transferred to the intermediate transfer belt.

In a configuration in which a cleaning unit for collecting toner is arranged on the photosensitive drum, the end-portion toner remaining in the photosensitive drum is collected to a cleaning container arranged on the cleaning unit. In other words, in order to prevent the cleaning container from being saturated with toner even if the end-portion toner is collected thereby, it is necessary to have a margin in the capacity of the cleaning container. However, if the cleaning container is increased in size, downsizing of the image forming apparatus will be difficult to achieve.

Further, in a configuration in which the cleaning unit for collecting toner is not arranged on the photosensitive drum, the end-portion toner spreads across a position where the photosensitive drum abuts on the charging member along with rotation of the photosensitive drum, so that the charging member is contaminated thereby. Thus, there is a risk in that an image defect may occur.

SUMMARY OF THE INVENTION

The present disclosure is directed to a technique of transferring toner that has moved to a photosensitive drum from an end portion of a development member to an intermediate transfer belt from the photosensitive drum, in an image forming apparatus which executes primary transfer processing by supplying electric current in a circumferential direction of the intermediate transfer belt.

According to an aspect of the present disclosure, an image forming apparatus includes an image bearing member configured to bear a toner image, a development unit having a development container for containing toner, an opening portion arranged on the development container, and a development member for bearing toner contained in the development container, and configured to develop a toner image on the image bearing member in such a manner that the development member bearing toner supplied from the development container abuts on the image bearing member, a rotatable endless intermediate transfer belt having electrical conductivity and configured to be in contact with the image bearing member, a current supply member configured to be in contact with the intermediate transfer belt to supply electric current to the intermediate transfer belt, wherein electric current supplied from the current supply member flows in a circumferential direction of the intermediate transfer belt to cause a toner image to be primarily transferred onto the intermediate transfer belt from the image bearing member, and a power source configured to apply voltage to the current supply member, wherein the intermediate transfer belt includes a plurality of layers including a first layer and a second layer, the first layer being a layer thickest among the plurality of layers in a thickness direction of the intermediate transfer belt, the second layer having electric resistance lower than electric resistance of the first layer and being formed at a position further away from the image bearing member than the first layer in a thickness direction of the intermediate transfer belt, and both end portions of the second layer are positioned outside of both end portions of the opening portion in a width direction of the intermediate transfer belt orthogonal to the circumferential direction.

Further features of the present disclosure will become apparent from the following description of exemplary embodiments with reference to the attached drawings.

DESCRIPTION OF THE EMBODIMENTS

Hereinafter, preferred exemplary embodiments embodying the present disclosure will be illustratively described in detail with reference to the appended drawings. Herein, sizes, materials, shapes and a relative arrangement of constituent elements described in the following present exemplary embodiments should be changed as appropriate according to a configuration or various conditions of the apparatus to which the present disclosure is applied. Accordingly, a scope of the present disclosure is not intended to be limited thereto unless such specific limitations are described in particular.

<Configuration of Image Forming Apparatus>

Figure 1:
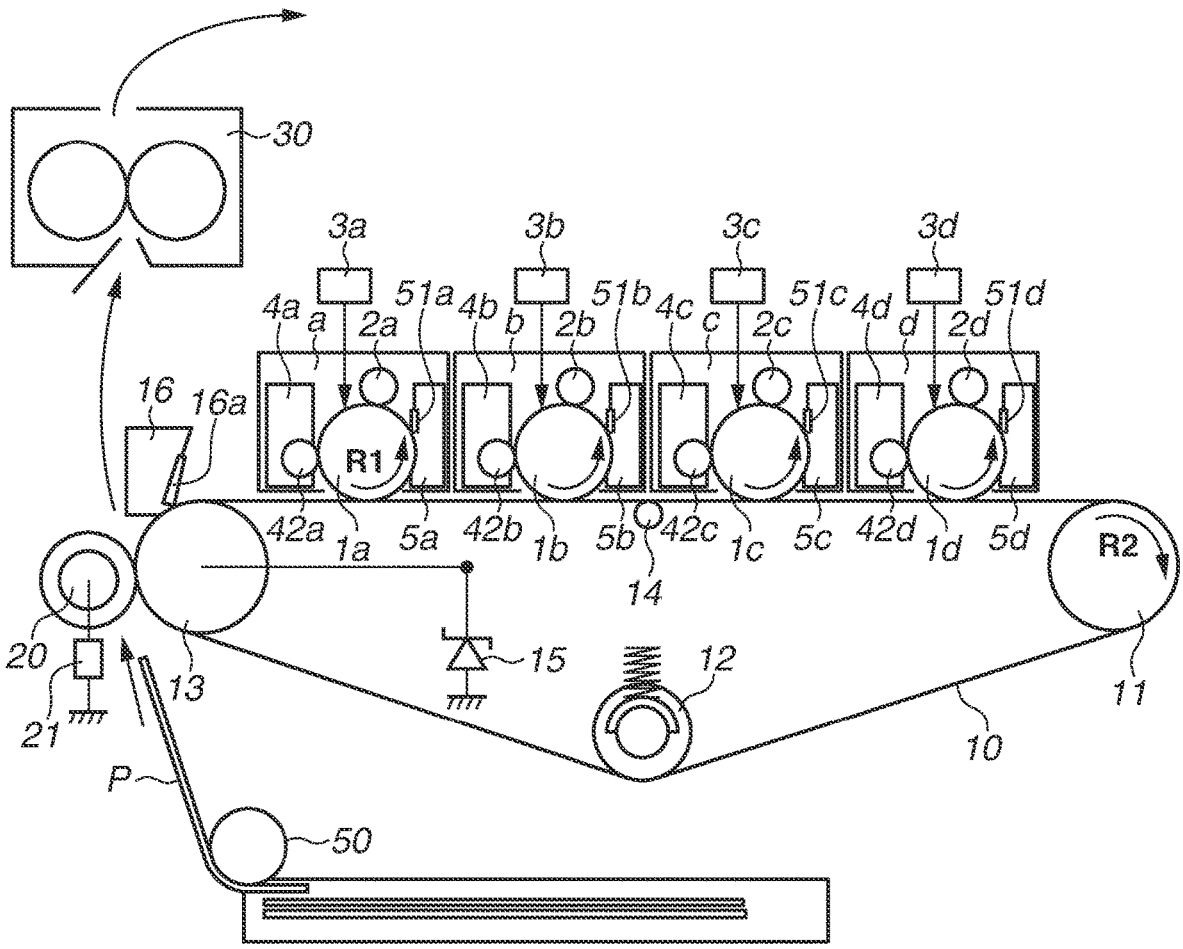
FIG. 1 is a cross-sectional diagram schematically illustrating an image forming apparatus in a first exemplary embodiment.

FIG. 1 is a cross-sectional diagram schematically illustrating a configuration of an image forming apparatus 100 of the present exemplary embodiment. The image forming apparatus 100 of the present exemplary embodiment is a so-called tandem type image forming apparatus including a plurality of image forming units a to d. The first, the second, the third, and the fourth image forming units a to d form images with toner of colors of yellow (Y), magenta (M), cyan (C), and black (Bk), respectively. The four image forming units a to d are arranged in a row with a certain space, and configurations thereof are practically common to each other except for colors of the toner contained therein. Accordingly, the configuration of the image forming apparatus 100 of the present exemplary embodiment will be described below with reference to the first image forming unit a.

The first image forming unit a includes a photosensitive drum 1*a* serving as a drum-shape photosensitive member, a charging roller 2*a* serving as a charging member, a development unit 4*a*, and a drum cleaning unit 5*a*.

The photosensitive drum 1*a* is an image bearing member that bears a toner image and rotationally driven in a direction indicated by an arrow R1 in FIG. 1 at a predetermined circumferential speed (process speed). The development unit 4*a* contains yellow toner, and develops a yellow toner image on the photosensitive drum 1*a*. The drum cleaning unit 5*a* collects toner adhered to the photosensitive drum 1*a*. The drum cleaning unit 5*a* includes a cleaning blade 51*a* that abuts on the photosensitive drum 1*a* and a waste toner box that contains toner removed from the photosensitive drum 1*a* by the cleaning blade 51*a*.

A control unit (not illustrated), such as a controller, receives an image signal to start image forming processing, so that the photosensitive drum 1*a* is driven rotationally. In the course of rotation, the photosensitive drum 1*a* is uniformly charged with a predetermined voltage (charging voltage) in a predetermined polarity (in the present exemplary embodiment, a negative polarity) by the charging roller 2*a*, and exposed to light according to the image signal by the exposure unit 3*a*. With this processing, an electrostatic latent image corresponding to a yellow color component image of a target color image is formed on the photosensitive drum 1*a*. Then, the electrostatic latent image is developed by the development unit 4*a* at a development position and visualized as a yellow toner image on the photosensitive drum 1*a*. Herein, a regular charging polarity of the toner contained in the development unit 4*a* is a negative polarity, and the electrostatic latent image is reversely developed with toner charged in a polarity the same as the charging polarity of the photosensitive drum 1*a* charged by the charging roller 2*a*. However, the present disclosure is not limited to the above, and the present disclosure is also applicable to an image forming apparatus that positively develops the electrostatic latent image with toner charged in a polarity opposite to the charging polarity of the photosensitive drum 1*a*.

A rotatable endless intermediate transfer belt 10 has electrical conductivity. The intermediate transfer belt 10 is in contact with the photosensitive drum 1*a* to form a primary transfer portion, and is rotationally driven at a circumferential speed substantially the same as that of the photosensitive drum 1*a*. Further, the intermediate transfer belt 10 is stretched upon a counter roller 13 serving as a counter member and a driving roller 11 and a tension roller 12 serving as stretching members. The yellow toner image formed on the photosensitive drum 1*a* is primarily transferred to the intermediate transfer belt 10 from the photosensitive drum 1*a* while passing through the primary transfer portion. After the primary transfer residual toner remaining on the surface of the photosensitive drum 1*a* is cleaned and removed by the drum cleaning unit 5*a*, the photosensitive drum 1*a* is charged and used for subsequent image forming processing.

When primary transfer processing is executed, electric current is supplied to the electrically-conductive intermediate transfer belt 10 from a secondary transfer roller 20 serving as a current supply member that is in contact with an outer circumferential surface of the intermediate transfer belt 10. The electric current supplied from the secondary transfer roller 20 flows in the circumferential direction of the intermediate transfer belt 10, so that a toner image is primarily transferred to the intermediate transfer belt 10 from the photosensitive drum 1*a*. Primary transfer processing of a toner image executed at the primary transfer portion in the present exemplary embodiment will be described below in detail.

Similarly, toner images in a second, a third, and a fourth colors, i.e., magenta, cyan, and black are formed by the second, the third, and the fourth image forming units b, c, and d, respectively, and sequentially overlapped and transferred onto the intermediate transfer belt 10. With this processing, a four color toner image corresponding to a target color image is formed on the intermediate transfer belt 10. Thereafter, the four color toner image borne by the intermediate transfer belt 10 is collectively and secondarily transferred onto a surface of a transfer material P, such as a sheet or an overhead projector (OHP) sheet, fed from a sheet feeding unit 50 while the transfer material passes through a secondary transfer portion formed by the secondary transfer roller 20 and the intermediate transfer belt 10 abutting each other.

A member having an outer diameter of 18 mm, which consists of a nickel-plated steel rod having an outer diameter of 6 mm covered with a formed sponge body mainly composed of a nitrile rubber (NBR) material and an epichlorohydrin rubber material adjusted to have a volume resistance of $10^8$ Ω·cm and a thickness of 6 mm, is used as the secondary transfer roller 20 serving as a current supply member. In addition, the formed sponge body has a rubber hardness of 30° when measurement is executed by using the Asker-C hardness meter at a weight of 500 g. The secondary transfer roller 20 is in contact with an outer circumferential surface of the intermediate transfer belt 10, and is pressed against the counter roller 13 as a counter member via the intermediate transfer belt 10 at a pressure force of 50 N to form a secondary transfer portion.

The secondary transfer roller 20 is driven and rotated along with the intermediate transfer belt 10, and electric current flows to the counter roller 13 serving as a counter member from the secondary transfer roller 20 when voltage is applied thereto from a transfer power source 21. With this configuration, the toner image borne by the intermediate transfer belt 10 is secondarily transferred to the transfer material P at the secondary transfer portion. When the toner image borne by the intermediate transfer belt 10 is secondarily transferred to the transfer material P, the voltage applied to the secondary transfer roller 20 from the transfer power source 21 is controlled, so that the electric current flowing to the counter roller 13 from the secondary transfer roller 20 via the intermediate transfer belt 10 becomes constant. Further, an amount of electric current supplied for the secondary transfer processing is previously determined according to a surrounding environment in which the image forming apparatus 100 is installed or a type of transfer material P. The transfer power source 21 is connected to the secondary transfer roller 20, and applies transfer voltage to the secondary transfer roller 20. Further, the transfer power source 21 can output transfer voltage of a range between 100 V to 4000 V.

The transfer material P on which the four color image is transferred through secondary transfer processing is heated and pressurized by a fixing unit 30, so that four colors of toner are fused and mixed together and fixed to the transfer material P. The toner remaining in the intermediate transfer belt 10 after secondary transfer processing is cleaned and removed by a belt cleaning unit 16 which is arranged to face the counter roller 13 via the intermediate transfer belt 10 on a downstream side of the secondary transfer portion in the moving direction of the intermediate transfer belt 10. The belt cleaning unit 16 includes a cleaning blade 16*a* that abuts on an outer circumferential surface of the intermediate transfer belt 10 and a waste toner container that contains toner removed from the intermediate transfer belt 10 by the cleaning blade 16*a*.

Through the above-described processing, the image forming apparatus 100 of the present exemplary embodiment forms a full-color printed image.

Subsequently, the intermediate transfer belt 10, the driving roller 11, the tension roller 12, the counter roller 13 serving as a counter member of the secondary transfer roller 20, and a metallic roller 14 serving as a contact member that is in contact with an inner circumferential surface of the intermediate transfer belt 10 will be described.

The intermediate transfer belt 10 is an endless belt made of a resinous material to which electrical conductivity is provided by adding a conductive agent. The intermediate transfer belt 10 is stretched around three rollers, i.e., the driving roller 11, the tension roller 12, and the counter roller 13, with a tensile force of a total pressure of 60 N applied by the tension roller 12.

The counter roller 13 is connected to a ground via a Zener diode 15 serving as a constant voltage element. The secondary transfer roller 20 to which voltage is applied from the transfer power source 21 supplies electric current to the counter roller 13, so that electric current flows in the Zener diode 15 via the counter roller 13. The Zener diode 15 serving as a constant voltage element maintains a predetermined voltage (hereinafter, referred to as "Zener voltage") when electric current is supplied to the Zener diode 15, and the Zener voltage is generated on a cathode side thereof when electric current of a predetermined amount or more is supplied thereto. In other words, one end (anode side) of the Zener diode 15 is connected to the ground whereas another end (cathode side) is connected to the counter roller 13, and the counter roller 13 is maintained at the Zener voltage when voltage is applied to the secondary transfer roller 20 from the transfer power source 21.

In the present exemplary embodiment, electric current flows to the photosensitive drums 1*a* to 1*d* from the counter roller 13 maintained at the Zener voltage via the intermediate transfer belt 10, so that toner images are primarily transferred to the intermediate transfer belt 10 from the photosensitive drums 1*a* to 1*d*. In this process, in the present exemplary embodiment, the Zener voltage is set to 300 V in order to acquire desired primary transfer efficiency.

As illustrated in FIG. 1, the intermediate transfer belt 10 is rotationally driven at a circumferential speed substantially the same as a circumferential speed of the photosensitive drum 1*a*, 1*b*, 1*c*, or 1*d* by the driving roller 11 that rotates in a direction indicated by an arrow R2 in FIG. 1 by receiving a driving force from a driving source (not illustrated). Further, as illustrated in FIG. 1, the metallic roller 14 as a contact member that is in contact with the inner circumferential surface of the intermediate transfer belt 10 is arranged at a position between the photosensitive drums 1*b* and 1*c*.

Figure 2A:
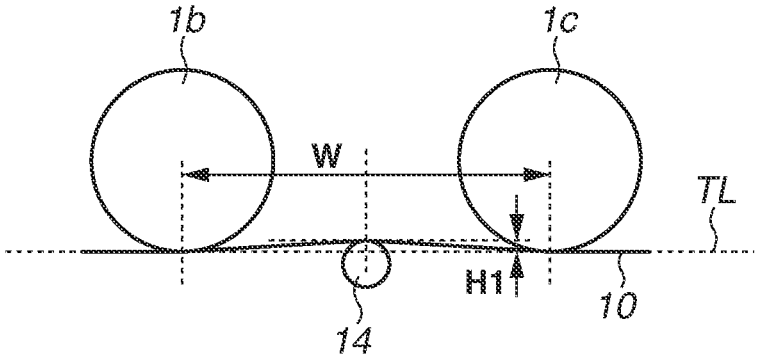
FIG. 2A is a diagram schematically illustrating an enlarged view of an image forming unit in the first exemplary embodiment.

FIG. 2A is a diagram schematically illustrating an enlarged view of a portion between the photosensitive drums 1*b* and 1*c*. As illustrated in FIG. 2A, the metallic roller 14 is arranged at an intermediary position of the photosensitive drums 1*b* and 1*c*. Further, in order to secure a winding amount of the intermediate transfer belt 10 with respect to the photosensitive drums 1*b* and 1*c*, the metallic roller 14 is arranged at a position shifted to a side of the photosensitive drums 1*b* and 1*c* from an imaginary line TL that connects the positions at which the photosensitive drums 1*b* and 1*c* are in contact with the intermediate transfer belt 10.

The metallic roller 14 is configured of a straight-shape nickel-plated cylindrical rod made of Steel Special Use Stainless (SUS) having an outer diameter of 6 mm, and rotated along with rotation of the intermediate transfer belt 10. The metallic roller 14 is arranged in an electrically floating state while abutting on the intermediate transfer belt 10 across a predetermined region in a width direction orthogonal to the moving direction of the intermediate transfer belt 10.

Herein, a distance between an axis center of the photosensitive drum 1*b* and an axis center of the photosensitive drum 1*c* is defined as "W", and a lifting height of the metallic roller 14 with respect to the imaginary line TL is defined as "H1". In the present exemplary embodiment, the distance W is 75 mm (W=75 mm) whereas the lifting height H1 is 2 mm (H1=2 mm). Further, a distance between each of the photosensitive drums 1*a*, 1*b*, 1*c*, and 1*d* is equally set to the distance W (i.e., W=75 mm).

Figure 2B:
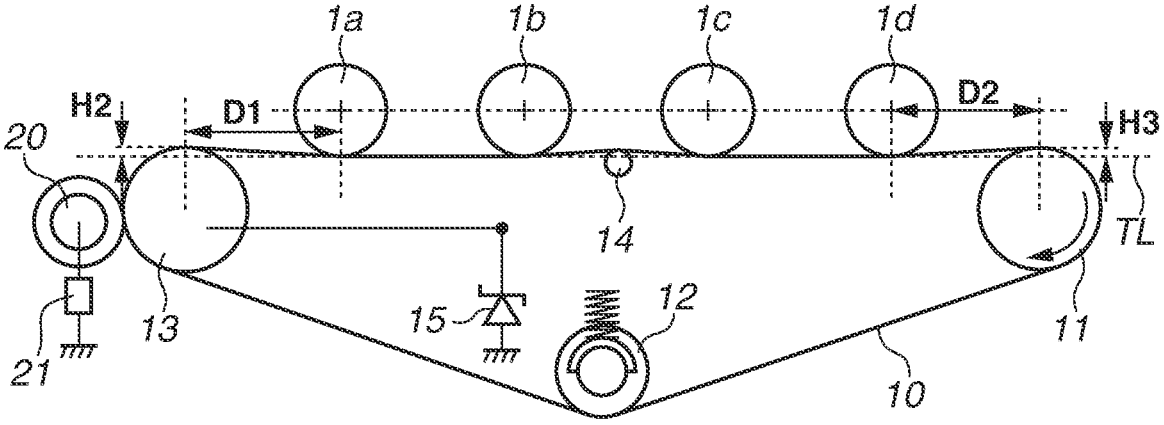
FIG. 2B is a cross-sectional diagram schematically illustrating an arrangement structure of respective members in the first exemplary embodiment.

FIG. 2B is a cross-sectional diagram schematically illustrating a configuration of the primary transfer portion of the present exemplary embodiment. In the present exemplary embodiment, in order to secure the winding amount of the intermediate transfer belt 10 with respect to the photosensitive drums 1*a* and 1*d*, the driving roller 11 and the counter roller 13 are arranged as illustrated in FIG. 2B. The driving roller 11 and the counter roller 13 are arranged at positions shifted to a side of the photosensitive drums 1*a* and 1*d* from the imaginary line TL that connects the positions at which the photosensitive drums 1*a*, 1*b*, 1*c* and 1*d* are in contact with the intermediate transfer belt 10. A distance between an axis center of the counter roller 13 and an axis center of the photosensitive drum 1*a* is defined as "D1", and a distance between an axis center of the driving roller 11 and an axis center of the photosensitive drum 1*d* is defined as "D2". Further, a lifting height of the counter roller and a lifting height of the driving roller 11 with respect to the imaginary line TL are defined as "H2" and "H3" respectively. In the present exemplary embodiment, the distances D1 and D2 are 50 mm (D1=D2=50 mm), and the lifting heights H2 and H3 are 2 mm (H2=H3=2 mm).

<Configuration of Intermediate Transfer Belt>

Figure 3:
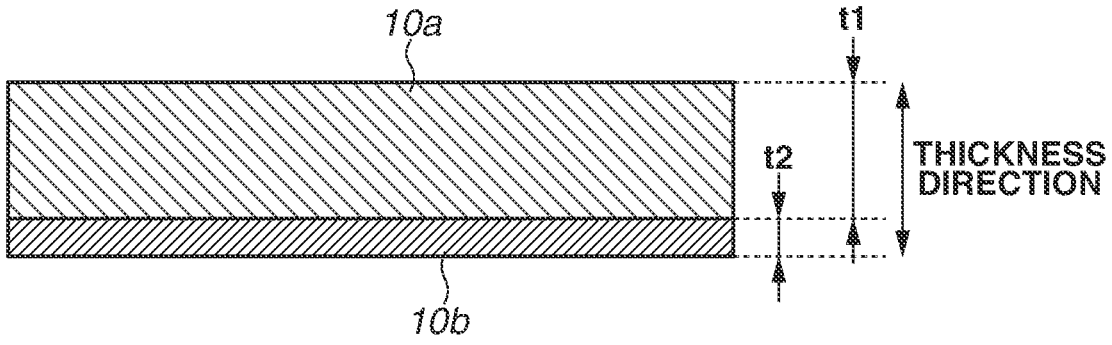
FIG. 3 is a diagram schematically illustrating a cross-section of an intermediate transfer belt in the first exemplary embodiment.

FIG. 3 is a diagram schematically illustrating a cross-section of the intermediate transfer belt 10 of the present exemplary embodiment viewed in an axis direction of the metallic roller 14. The intermediate transfer belt 10 has a perimeter of 700 mm and a thickness of 90 μm, and is formed of a base layer 10*a* (first layer) and an inner surface layer 10*b* (second layer). An endless polyvinylidene fluoride (PVdF) material mixed with an ionic conductive agent (e.g., multivalent metal salt or quaternary ammonium salt) as a conductive agent is used as the base layer 10*a*, and an acrylic resin material mixed with carbon as a conductive agent is used as the inner surface layer 10*b*.

Herein, the base layer 10*a* is defined as a layer that is the thickest from among the layers constituting the intermediate transfer belt 10 in the thickness direction of the intermediate transfer belt 10. Further, in the present exemplary embodiment, the inner surface layer 10*b* is a layer formed on an inner circumferential surface side of the intermediate transfer belt 10, and the base layer 10*a* is formed at a position closer to the photosensitive drums 1*a* to 1*d* than the inner surface layer 10*b* in the thickness direction orthogonal to the moving direction of the intermediate transfer belt 10. In the present exemplary embodiment, the inner surface layer 10*b* of the intermediate transfer belt 10 is formed by applying spray coating on the base layer 10*a*. If a thickness of the base layer 10*a* is defined as "t1" and a thickness of the inner surface layer 10*b* is defined as "t2", the thickness t1 is 87 μm (t1=87 μm), whereas the thickness t2 is 3 μm (t2=3 μm).

In the present exemplary embodiment, although polyvinylidene fluoride (PVdF) is used as a material of the base layer 10*a*, the exemplary embodiment is not limited thereto. For example, a material, such as polyester resin or a copolymer of acrylonitrile-butadiene-styrene (ABS) resin or a material consisting of a mixture of these resinous materials, may be used. Further, in the present exemplary embodiment, although acrylic resin is used as a material of the inner surface layer 10*b*, another material, such as polyester resin, may be used.

In addition, tetra-ethyl ammonium ions, tetra-propyl ammonium ions, tetra-isopropyl ammonium ions, tetra-butyl ammonium ions, tetra-pentyl ammonium ions, or tetra-hexyl ammonium ions may be a cationic moiety of the quaternary ammonium salt as an ionic conductive agent, and halogen ions or a fluorinated alkyl group having 1 to 10 carbon atoms (e.g., fluorinated alkyl sulfate ions, fluorinated alkyl sulfite ions, or fluorinated alkyl borate ions) may be an anionic moiety thereof.

In the present exemplary embodiment, the intermediate transfer belt 10 consisting of the base layer 10*a* and the inner surface layer 10*b* having different electric resistances is used, and the electric resistance of the inner surface layer 10*b* is set to be lower than that of the base layer 10*a*. Because of a relationship between the base layer 10*a* and the inner surface layer 10*b* with respect to the electric resistances and the thicknesses thereof, the volume resistivity of the intermediate transfer belt 10 reflects the electric resistance of the base layer 10*a*, and the surface resistivity of the intermediate transfer belt 10 on the inner circumferential surface side reflects the electric resistance of the inner surface layer 10*b*. In a reference environment having a temperature of 23° C. and a humidity of 50%, the volume resistivity of the intermediate transfer belt 10 is $5\times10^9$ Ω·cm, and the surface resistivity of the intermediate transfer belt 10 on the inner circumferential surface side is $1.0\times10^6$ Ω/sq.

The volume resistivity of the intermediate transfer belt 10 and the surface resistivity thereof on the inner circumferential surface side are measured in a measurement environment having a temperature of 23° C. and a humidity of 50% by using a resistivity meter "Hiresta-UP (model: MCP-HT450)" by Mitsubishi Chemical Corporation. A UR-type ring probe (model: MCP-HTP12) is used for measuring the volume resistivity. The probe is applied on a surface side of the intermediate transfer belt 10, and measurement is executed under the condition of applied voltage of 100 V and measurement time of 10 seconds. A UR100-type ring probe (model: MCP-HTP16) is used for measuring the surface resistivity on the inner circumferential surface side. The probe is applied on the inner circumferential surface side of the intermediate transfer belt 10, and measurement is executed under the condition of applied voltage of 10 V and measurement time of 10 seconds.

In the present exemplary embodiment, a toner image is primarily transferred at each of the primary transfer portions of the image forming units a to d by supplying electric current in the circumferential direction of the intermediate transfer belt 10. In the above-described configuration, because the counter roller 13 maintained at the Zener voltage is away from the photosensitive drums 1*a* to 1*d*, the electric current supplied for primary transfer processing flows in the intermediate transfer belt 10 over a long distance. In this case, because voltage at each of the primary transfer portions of the image forming units a to d (hereinafter, referred to as "primary transfer voltage") drops in accordance with a distance which the electric current flows in the circumferential direction of the intermediate transfer belt 10, the primary transfer voltage is likely to be influenced by variation in the electric resistance of the intermediate transfer belt 10.

The intermediate transfer belt 10 of the present exemplary embodiment includes the base layer 10*a* having ionic conductivity and containing an ionic conductive agent and the inner surface layer 10*b* having electronic conductivity and containing carbon as an electronic conductive agent. Although distribution of electric resistance is uniform in a material containing an ionic conductive agent in comparison to the case of a material containing an electronic conductive agent, the electric resistance thereof tends to vary according to a surrounding environment. More specifically, the electric resistance tends to be lower in the environment having a high temperature and a high humidity and tends to be higher in the environment having a low temperature and a low humidity. Accordingly, in a case where a toner image is transferred by supplying electric current in the circumferential direction of the intermediate transfer belt 10 that contains the iconic conductive agent, there is a risk in that the primary transfer voltages at the image forming units a to d may be different from each other because of an influence of variation in the electric resistance. Therefore, it is difficult to acquire desired primary transfer voltage at each of the primary transfer portions, and thus there is a risk in that an image defect may occur.

Figure 4:
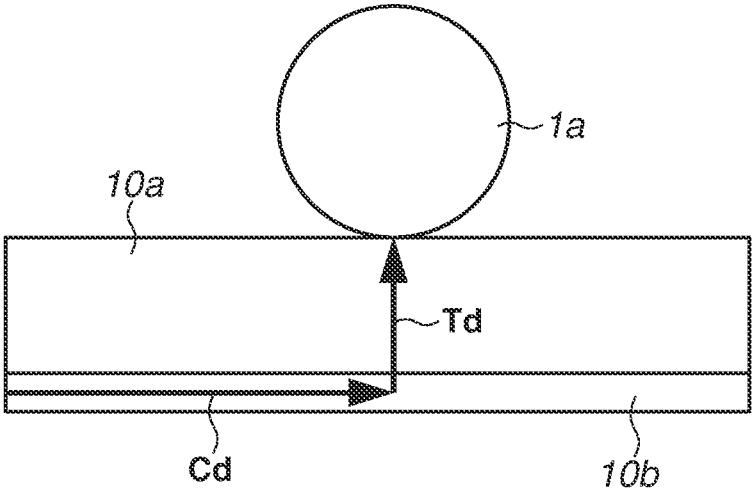
FIG. 4 is a diagram schematically illustrating electric current flowing in an image bearing member via the intermediate transfer belt in the first exemplary embodiment.

However, an image defect caused by variation in the surrounding environment has not occurred in the configuration described in the present exemplary embodiment. This is because the intermediate transfer belt 10 of the present exemplary embodiment includes the electronically-conductive inner surface layer 10*b* having the electric resistance lower than that of the base layer 10*a* on the inner circumferential surface side thereof. Hereinafter, a path of electric current flowing to each of the photosensitive drums 1*a* to 1*d* via the intermediate transfer belt 10 will be described with mainly reference to the electric current flowing to the photosensitive drum 1*a*. FIG. 4 is a diagram schematically illustrating the electric current flowing in the photosensitive drum 1*a* via the intermediate transfer belt 10 in the present exemplary embodiment.

As illustrated in FIG. 4, electric current flowing in the intermediate transfer belt 10 from the counter roller 13 maintained at the Zener voltage flows in the inner surface layer 10*b* having electric resistance lower than that of the base layer 10*a* in a direction indicated by an arrow Cd in FIG. 4 (i.e., a circumferential direction of the intermediate transfer belt 10). Then, at the primary transfer portion where the photosensitive drum 1*a* is in contact with the intermediate transfer belt 10, electric current flows in a direction indicated by an arrow Td in FIG. 4, i.e., a thickness direction of the base layer 10*a*, from the inner surface layer 10*b*, to the photosensitive drum 1*a* charged in a potential lower than that of the intermediate transfer belt 10. With this configuration, a toner image is primarily transferred to the intermediate transfer belt 10 from the photosensitive drum 1*a*.

The inner surface layer 10*b* has an electronically-conductive electric characteristic, and electric resistance thereof is almost unchanged regardless of the surrounding environment. Further, because the base layer 10*a* has ionic conductivity, electric resistance thereof changes according to the surrounding environment. However, in the present exemplary embodiment, a path of the electric current flowing in the base layer 10*a* only has a length corresponding to the thickness of the base layer 10*a*, and thus the path is shorter than a distance which the electric current flows in the direction indicated by the arrow Cd in FIG. 4 in the inner surface layer 10*b*. Accordingly, in comparison to an intermediate transfer belt consisting of only the ionically-conductive base layer 10*a* without having the inner surface layer 10*b*, the intermediate transfer belt 10 of the present exemplary embodiment can suppress variation in the primary transfer voltage caused by variation in the electric resistance of the ionically-conductive base layer 10*a*. Therefore, in a configuration of the present exemplary embodiment in which primary transfer processing is executed by supplying electric current in the circumferential direction of the intermediate transfer belt 10, appropriate primary transfer voltage can be acquired at each of the image forming units a to d, and thus it is possible to suppress occurrence of the image defect.

In the present exemplary embodiment, the intermediate transfer belt 10 having volume resistivity in a range of $1\times10^{9}$ to $1\times10^{10}$ Ω·cm and surface resistivity on the inner circumferential surface side of $4.0\times10^{6}$ Ω/sq or less is used. If the volume resistivity of the intermediate transfer belt 10 is high, the intermediate transfer belt 10 is charged up easily, so that there is a risk in that electric discharge may occur in the intermediate transfer belt 10 and the photosensitive drum 1*a*. Further, if the volume resistivity of the intermediate transfer belt 10 is low, an amount of electric current flowing in the intermediate transfer belt 10 is greater in a region without toner than in a region with toner, so that there is a risk in that a transfer defect may occur. Accordingly, it is preferable that the volume resistivity of the intermediate transfer belt 10 be set within a range of $1\times10^{9}$ to $1\times10^{10}$ Ω·cm.

If the surface resistivity of the intermediate transfer belt 10 on the inner circumferential surface side is high, voltage formed at the primary transfer portion away from the counter roller 13 maintained at the Zener voltage drops and becomes lower than the Zener voltage. Therefore, a difference arises in values of the electric current flowing to the photosensitive drums 1*a* to 1*d* from the intermediate transfer belt 10, so that there is a risk in that unevenness occurs in the primary transfer efficiency in the image forming units a to d. Accordingly, it is preferable that the surface resistivity of the intermediate transfer belt 10 on the inner circumferential surface side be set to $4.0\times10^{6}$ Ω/sq or less. In addition, although the surface resistivity on the inner circumferential surface side can be lowered if a thickness of the inner surface layer 10*b* is greater, there is a risk in that the inner surface layer 10*b* may be torn off or may peel off from the base layer 10*a* because of a bend of the intermediate transfer belt 10 if the inner surface layer 10*b* is too thick. In consideration of the above-described issues, a thickness of the inner surface layer 10*b* may preferably be set within a range of 1 μm to 5 μm. Therefore, in the present exemplary embodiment, the thickness of the inner surface layer 10*b* is set to 3 μm with respect to the thickness of 87 μm of the base layer 10*a*.

<Collection of End-Portion Toner Formed in Development Unit>

Figure 5:
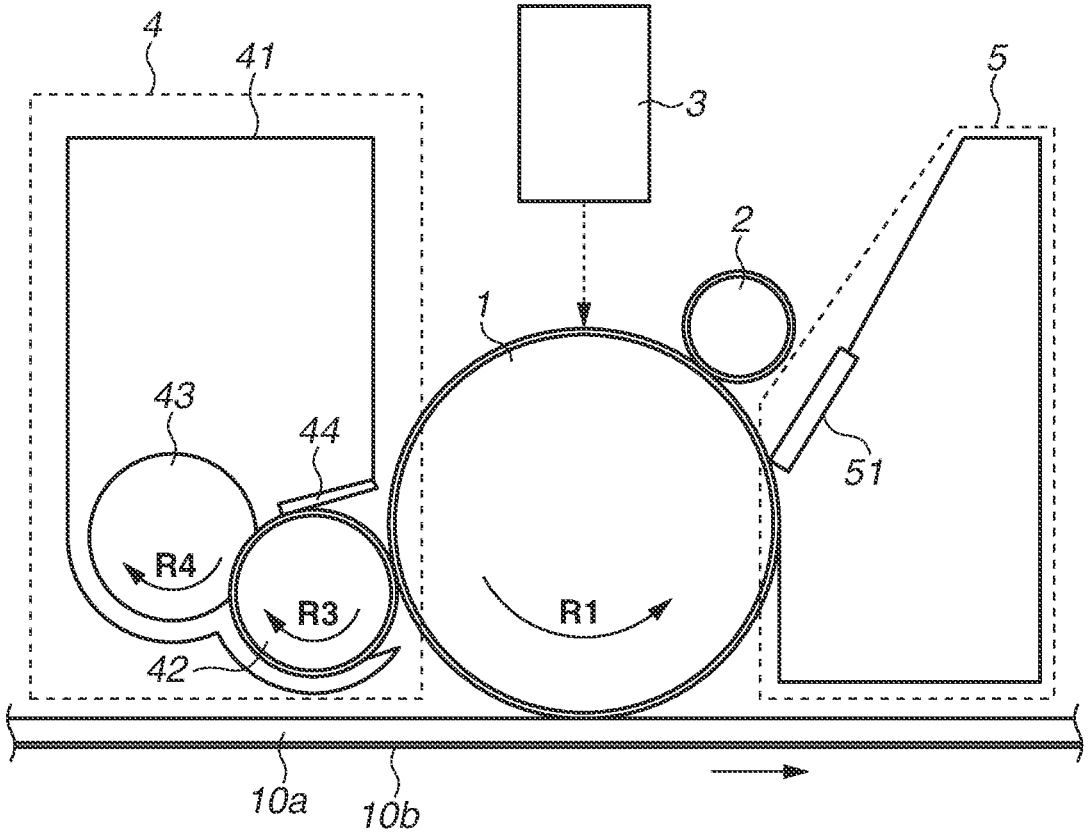
FIG. 5 is a diagram schematically illustrating a configuration of the image forming unit in the first exemplary embodiment.
Figure 6:
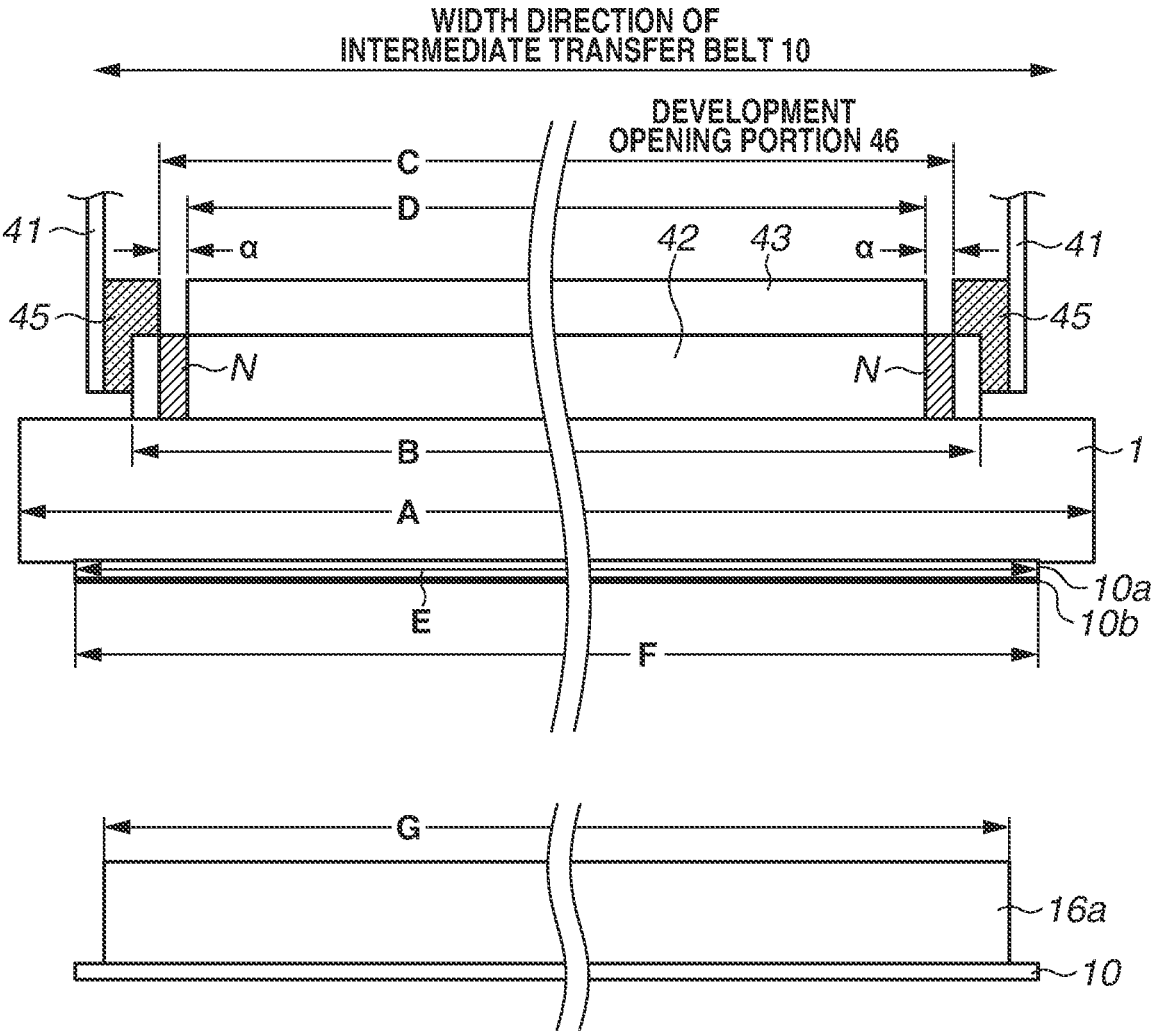
FIG. 6 is a diagram schematically illustrating a configuration of a development unit viewed in a conveyance direction of the intermediate transfer belt in the first exemplary embodiment.

Configurations of the development units 4*a* to 4*d* in the present exemplary embodiment will be described in detail with reference to FIGS. 5 and 6. Because configurations of the image forming units a to d or the development units 4*a* to 4*d* are similar to each other, the alphabetical characters "a" to "d" are omitted in the following description. FIG. 5 is a diagram schematically illustrating a configuration of the image forming unit in the present exemplary embodiment, and FIG. 6 is a diagram schematically illustrating a configuration of the development unit 4 viewed in a conveyance direction of the intermediate transfer belt 10 in the present exemplary embodiment.

As illustrated in FIG. 5, the development unit 4 includes a development container 41 for containing toner, a development roller 42 serving as a development member, a supply roller 43 serving as a toner supply member, and a development blade 44.

The development roller 42 is a roller having a multi-layer structure, configured of a stainless steel core metal, a urethane rubber layer as a base layer formed on a surface of the core metal, and a urethane rubber elastic layer in which electric resistance thereof is adjusted by adding a conductive agent such as carbon, which is formed on a surface of the base layer. The development roller 42 is rotatably arranged with respect to the development container 41, and abuts on the photosensitive drum 1 while bearing toner contained in the development container 41 to develop an electrostatic latent image formed on the photosensitive drum 1 into a toner image. The development roller 42 abuts on the photosensitive drum 1 at a predetermined contact pressure, and rotates in a direction opposite to a direction indicated by an arrow R1 in FIG. 5 as a rotation direction of the photosensitive drum 1 (i.e., a direction indicated by an arrow R3 in FIG. 5) at a circumferential speed of 120 mm/s. Further, when a toner image is to be developed on the photosensitive drum 1, a predetermined voltage (in the present exemplary embodiment, 300 V) is applied to the development roller 42 from a development power source (not illustrated).

The supply roller 43 includes a stainless steel core metal and an elastic foam body, such as a urethane layer, formed on a surface of the core metal. The supply roller 43 is rotatably arranged on the development container 41, and abuts on the development roller 42 to supply toner contained in the development container 41 to the development roller 42. The supply roller 43 abuts on the development roller 42 at a predetermined contact pressure, and rotates in a direction indicated by an arrow R4 in FIG. 5 at a circumferential speed of 120 mm/s. The supply roller 43 and the development roller 42 rotate in a same direction, so that the supply roller 43 and the development roller 42 move in opposite directions at a position where the supply roller 43 abuts on the development roller 42. With this configuration, in addition to supplying toner to the development roller 42, the supply roller 43 can remove toner remaining in the development roller 42 without being developed at a position where the development roller 42 abuts on the photosensitive drum 1.

The development blade 44 is a stainless-steel thin plate spring arranged on the development container 41. The development blade 44 abuts on the development roller 42 to regulate toner on the development roller 42 and forms a thin layer of toner on the development roller 42. In this process, because of friction between the development roller and the development blade 44, electric charge in a predetermined polarity (in the present exemplary embodiment, a negative polarity) is applied to the toner. After that, through rotation of the development roller 42, the toner to which electric charge in a predetermined polarity is applied moves to the photosensitive drum 1 at a position where the photosensitive drum 1 abuts on the development roller 42, so that a latent image formed on the photosensitive drum 1 is developed thereby.

As illustrated in FIG. 6, end portion sealings 45 (sealing members) are arranged on inner faces of side walls of the development container 41, and a development opening portion 46 (opening portion) for supplying toner to the development roller 42 from the development container 41 is formed at a space between the end portion sealings 45 arranged on both ends. Each of the end portion sealings 45 overlaps with a different one of end portions of the development roller 42 to prevent toner from leaking out from a space between the both end portions of the development roller 42 and the side walls of the development container 41. Further, the development opening portion 46 is a region which enables toner contained in the development container 41 to abut on the development roller 42.

If end portions of the supply roller 43 abut on the end portion sealings 45, there is a risk in that sponge materials provided on the end portions of the supply roller 43 may be scraped off. Therefore, a longitudinal width D of the supply roller 43 is set to be shorter than a longitudinal width C of the development opening portion 46 in a width direction of the development roller 42, and an empty space (gap) a is provided in a region between each of the end portions of the supply roller 43 and the corresponding one of the end portion sealings 45, so that the supply roller 43 and the end portion sealings 45 are brought into a non-contact state. Toner is supplied to a region N of the development roller 42 corresponding to the empty space α because the region N is positioned on the inner side of the longitudinal width C of the development opening portion 46. On the other hand, because the region N is positioned on the outside of the longitudinal width D of the supply roller 43, i.e., a region outside of an image forming region, toner is not removed therefrom by the supply roller 43. Accordingly, at a position on the photosensitive drum 1 corresponding to the region N of the development roller 42, there arises a phenomenon in which toner is developed when image forming processing is executed although the position does not correspond to the image forming region. Hereinafter, toner borne in the region N of the development roller 42 is called as "end-portion toner".

Along with rotation of the photosensitive drum 1, the end-portion toner that has moved to the photosensitive drum 1 reaches the primary transfer portion where the photosensitive drum 1 is in contact with the intermediate transfer belt 10. In this process, if the end-portion toner remains in the photosensitive drum 1 without being transferred to the intermediate transfer belt 10, the end-portion toner reaches a position where the cleaning blade 51 of the drum cleaning unit 5 abuts on the photosensitive drum 1 along with rotation of the photosensitive drum 1. Then, the end-portion toner is collected to the drum cleaning unit 5 by the cleaning blade 51 at a position where the cleaning blade 51 abuts on the photosensitive drum 1.

In this case, an amount of toner collected by the drum cleaning unit 5 is increased. Therefore, in order to prevent saturation of the waste toner container caused by collection of the end-portion toner, capacity of the waste toner container of the drum cleaning unit 5 has to be sufficiently large. However, if the capacity of the waste toner container is increased, a size of the drum cleaning unit 5 is also increased. As a result, it is difficult to shorten a distance between each of the image forming units a to d, and thus downsizing of the image forming apparatus becomes difficult.

Further, as described in the present exemplary embodiment, in the image forming apparatus 100 using an intermediate transfer method, first printout time (FPOT) can be shortened if a distance between each of the image forming units a to d is shorter. Herein, the first printout time refers to time taken to complete image formation on the first transfer material P to discharge the first transfer material P from the image forming apparatus 100. Accordingly, if shortening a distance between each of the image forming units a to d is difficult because of an increase in size of the waste container, it is difficult to improve the usability by shortening the FPOT.

On the contrary, in the present exemplary embodiment, the end-portion toner can be transferred to the intermediate transfer belt 10 from the photosensitive drum at the primary transfer portion. In other words, as illustrated in FIG. 6, a longitudinal width F of the inner surface layer 10*b* is set to be longer than a longitudinal width D of the supply roller 43 in the width direction of the intermediate transfer belt 10 orthogonal to the conveyance direction of the intermediate transfer belt 10, and both end portions of the inner surface layer 10*b* are arranged further outside than the both end portions of the development opening portion 46. With this configuration, in a state where the primary transfer voltage is appropriately formed in the entire region of the intermediate transfer belt 10, the end-portion toner can be transferred to the intermediate transfer belt 10 from the photosensitive drum 1 at the primary transfer portion.

In addition, along with the movement of the intermediate transfer belt 10, the end-portion toner transferred to the intermediate transfer belt 10 from the photosensitive drum 1 is collected to the belt cleaning unit 16 at a position where the cleaning blade 16*a* of the belt cleaning unit 16 abuts on the intermediate transfer belt 10. As illustrated in FIG. 6, in the present exemplary embodiment, a longitudinal width G of the cleaning blade 16*a* is set to be longer than a longitudinal width C of the development opening portion 46 in the width direction of the intermediate transfer belt 10, and both end portions of the cleaning blade 16*a* are arranged further outside than the both end portions of the development opening portion 46. With this configuration, the end-portion toner transferred to the intermediate transfer belt 10 can be collected by the cleaning blade 16*a*.

Figure 7:
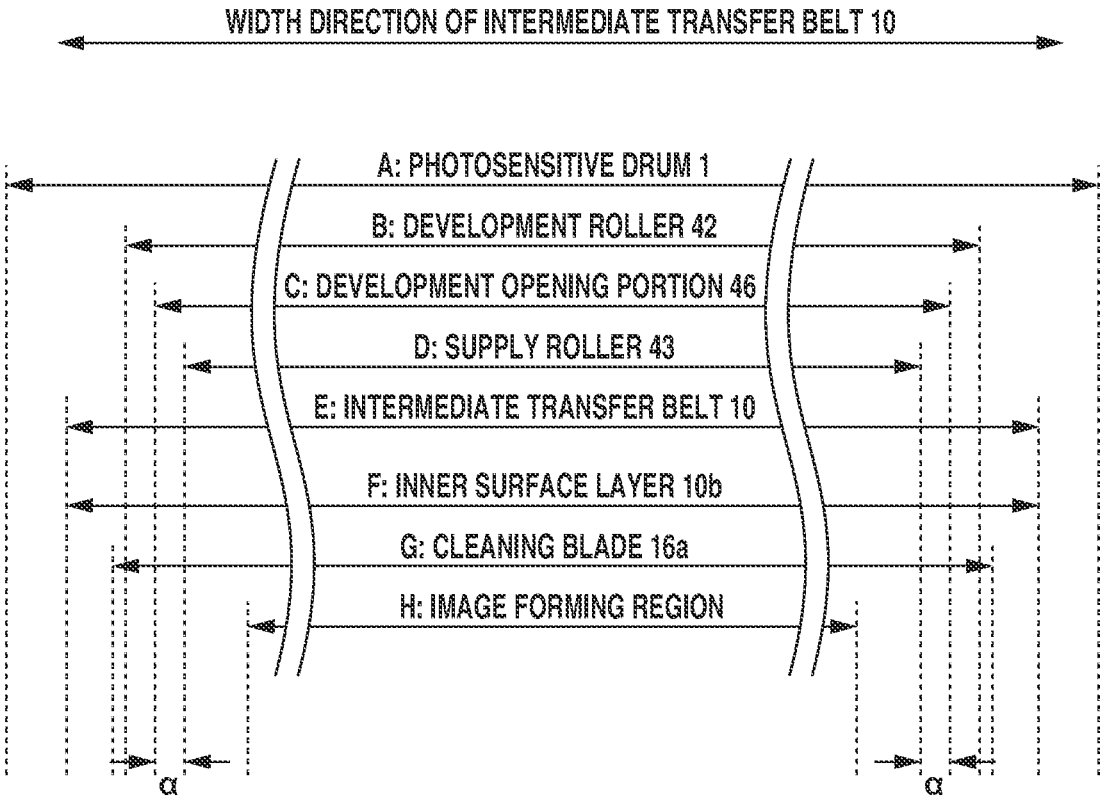
FIG. 7 is a diagram schematically illustrating a relationship between longitudinal widths of respective members in a width direction of the intermediate transfer belt in the first exemplary embodiment.

FIG. 7 is a diagram schematically illustrating a relationship between lengthwise widths of members in the width direction of the intermediate transfer belt 10. In the present exemplary embodiment, a longitudinal width A of the photosensitive drum 1 is 250 mm, a longitudinal width B of the development roller 42 is 224 mm, a longitudinal width C of the development opening portion 46 is 222 mm, and a longitudinal width D of the supply roller 43 is 220 mm. Further, a longitudinal width E of the intermediate transfer belt 10 is 236 mm, a longitudinal width F of the inner surface layer 10*b* is 236 mm, a longitudinal width G of the cleaning blade 16*a* abutting on the intermediate transfer belt 10 is 225 mm, and a longitudinal width H of an image forming region is 212 mm. In addition, a portion as a difference between the longitudinal width C of the development opening portion 46 and the longitudinal width D of the supply roller 43 corresponds to the empty space $\alpha$ between each of the end portion sealings 45 and the supply roller 43, and in the present exemplary embodiment, the space $\alpha$ is 1 mm ($\alpha$=1 mm). The end-portion toner is formed in the region N of the development roller 42 corresponding to the space $\alpha$.

As described above, in the present exemplary embodiment, the longitudinal width F of the inner surface layer 10*b* of the intermediate transfer belt 10 is set to be longer than the longitudinal width C of the development opening portion 46, and the both end portions of the inner surface layer 10*b* are arranged further outside than the both end portions of the development opening portion 46. With this configuration, if the end-portion toner formed in the region N of the development roller 42 moves to the photosensitive drum 1, the end-portion toner is transferred to the intermediate transfer belt 10 from the photosensitive drum 1 at the primary transfer portion, so that the end-portion toner can be collected by the belt cleaning unit 16. As a result, an increase in size of the waste toner container of the drum cleaning unit 5 can be suppressed, and thus an increase in size of the image forming apparatus 100 caused by an increase in a space between each of the image forming units a to d can be suppressed. Further, the FPOT can be suppressed from being longer.

Figure 8:
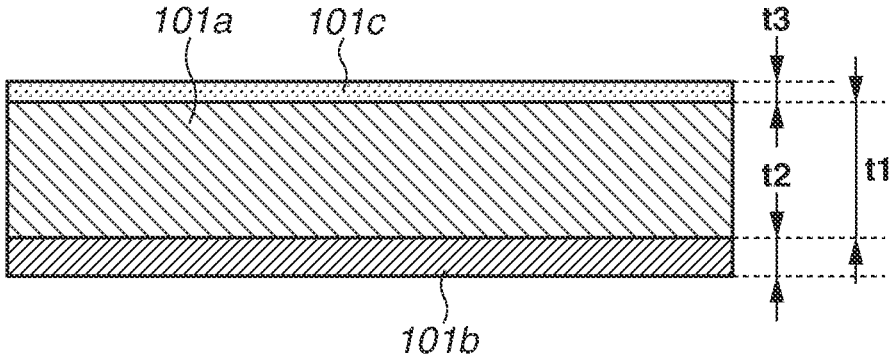
FIG. 8 is a diagram schematically illustrating a cross-section of an intermediate transfer belt in a variation example.

In the present exemplary embodiment, although the intermediate transfer belt 10 consisting of two layers such as the ionically-conductive base layer 10*a* and the electronically-conductive inner surface layer 10*b* is used, the intermediate transfer belt 10 does not have to be a two-layer structure. For example, as a variation example of the present exemplary embodiment, an example of an intermediate transfer belt 110 having a three-layer structure is illustrated in FIG. 8. As illustrated in FIG. 8, the intermediate transfer belt 110 as the variation example includes a surface layer 110*c* (third layer) in addition to a base layer 110*a* and an inner surface layer 110*b*. Further, the surface layer 110*c* is formed at a position closer to the photosensitive drums 1*a* to 1*d* than the base layer 110*a* in the thickness direction of the intermediate transfer belt 110.

Acrylic resin or polyester resin mixed with metallic oxide as a conductive agent can be used as a material of the surface layer 110*c*. In the example in FIG. 9, acrylic resin is used as a material of the surface layer 110*c*. Further, if a thickness of the surface layer 110*c* is defined as t3, the thickness t3 in the variation example is 2 μm (t3=2 μm). If the surface layer 110*c* is too thick, there is a risk in that the surface layer 110*c* may be torn off or may peel off from the base layer 110*a* because of a bend of the intermediate transfer belt 110. In consideration of the above-described issues, a thickness of the surface layer 110*c* may preferably be set within a range of 1 μm to 5 μm.

Surface resistivity of the surface layer 110*c* measured by a measurement method the same as the measurement method of the inner surface layer 10*b* is $1.0\times10^{12}$ Ω/sq when the applied voltage is 100 V. As described in the variation example, because the surface layer 110*c* has electronic conductivity, an influence of variation in the electric resistance of the ionically-conductive base layer 110*a* caused by variation in the surrounding environment can be reduced. Further, in a case where the surface resistivity of the base layer 110*a* in the intermediate transfer belt 110 having a three-layer structure is to be measured, measurement similar to measurement of the base layer 10*a* of the intermediate transfer belt 10 described in the first exemplary embodiment may be executed after the surface layer 110*c* is scraped or removed from the base layer 110*a*.

Further, a material such as the base layer 110*a* having ionic conductivity described in the present exemplary embodiment exhibits electric conductivity because of movement of ions included in the material. Therefore, unevenness in the ionic conductive agent occurs because of long-time use, and the iconic conductive agent may ooze out. However, as described in the variation example, with the configuration in which the electronically-conductive surface layer 110*c* and the electronically-conductive inner surface layer 110*b* are arranged to hold the ionically-conductive base layer 110*a* from an upper face and a lower face thereof, an effect of suppressing oozing of the ionic conductive agent can be acquired.

Further, in the present exemplary embodiment, although the Zener diode 15 is used as a constant voltage element, the exemplary embodiment is not limited thereto, and a varistor may be used. Further, electric current may be supplied to each of the photosensitive drums 1*a* to 1*d* from the secondary transfer roller 20 to which voltage is applied from the transfer power source 21 via the intermediate transfer belt 10 without using the Zener diode 15. In this case, the electric current flowing from the secondary transfer roller 20 flows in the circumferential direction of the inner surface layer 10*b* after flowing in the thickness direction of the base layer 10*a* to the inner surface layer 10*b*, and flows in the thickness direction of the base layer 10*a* to the photosensitive drums 1*a* to 1*d* from the inner surface layer 10*b* at each of the primary transfer portions.

Further, in the present exemplary embodiment, although the metallic roller 14 is used as a contact member, the exemplary embodiment is not limited thereto, and a roller member having an electrically-conductive elastic layer, an electrically-conductive sheet member, or an electrically-conductive brush member may be also used. Further, in the present exemplary embodiment, although the metallic roller 14 is only arranged on a space between the image forming units b and c, a plurality of metallic rollers 14 may be arranged on the upstream side or the downstream side of each of the image forming units a to d.

In the present exemplary embodiment, a configuration of the blade cleaning method using the cleaning blade 16*a* is described as a cleaning method of the intermediate transfer belt 10. However, the exemplary embodiment is not limited thereto, and toner may be collected to the waste toner container by using a fur brush.

In the first exemplary embodiment, a configuration in which toner remaining in the photosensitive drum 1*a* after transferring a toner image to the intermediate transfer belt 10 from the photosensitive drum 1*a* is collected by the drum cleaning unit 5*a* has been described. In a second exemplary embodiment, a so-called "cleaner-less configuration", in which toner remaining in the photosensitive drum 1*a* after transferring a toner image to the intermediate transfer belt 10 from the photosensitive drum 1*a* is collected by the development unit 4*a*, will be described with reference to FIG. 9. A configuration of an image forming apparatus 200 of the present exemplary embodiment is similar to the configuration described in the first exemplary embodiment except that each of the image forming units a to d has a cleaner-less configuration. Thus, the same reference numerals are applied to the elements similar to those of the first exemplary embodiment, and description thereof will be omitted.

Figure 9:
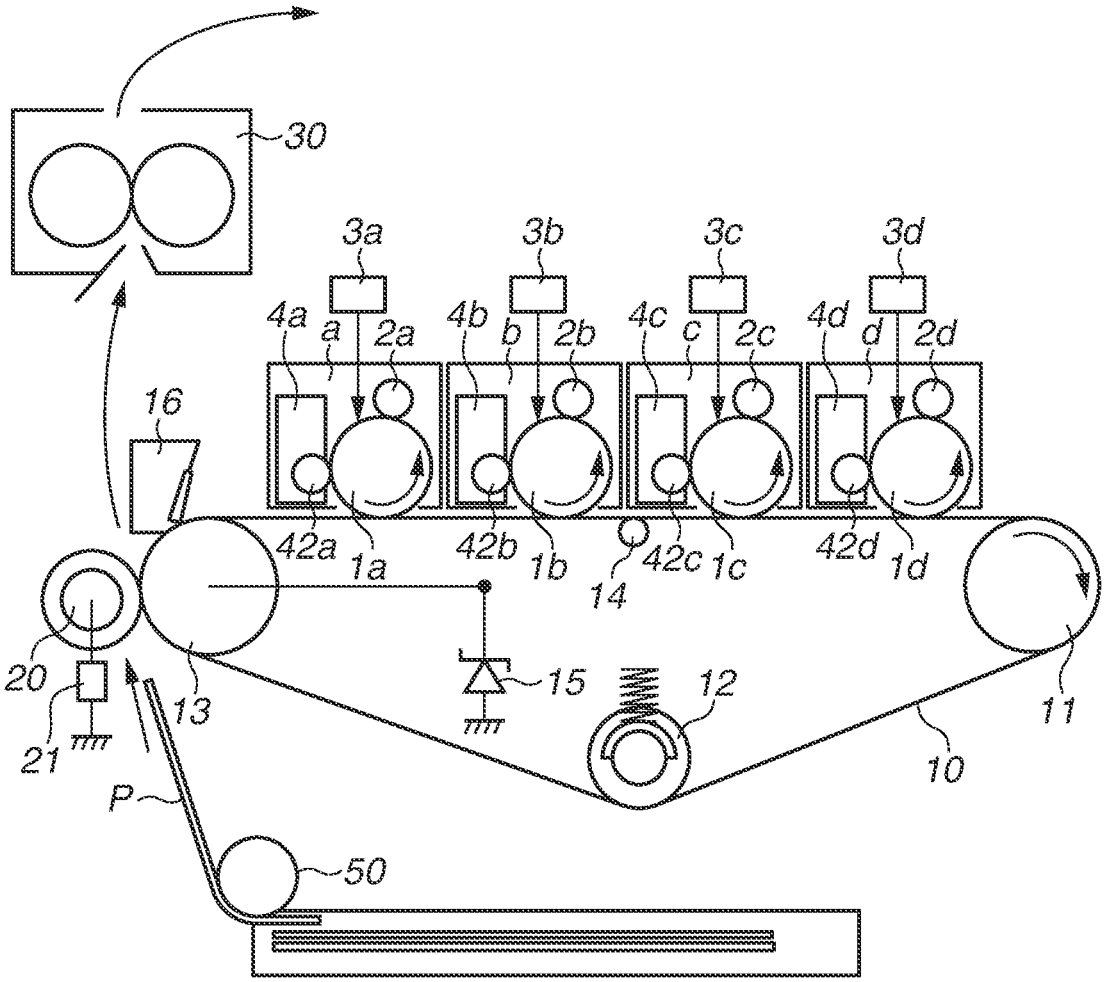
FIG. 9 is a cross-sectional diagram schematically illustrating a configuration of an image forming apparatus in a second exemplary embodiment.

FIG. 9 is a diagram schematically illustrating a configuration of the image forming apparatus 200 of the present exemplary embodiment. Because configurations of the image forming units a to d in the present exemplary embodiment are similar to each other, the alphabetical characters "a" to "d" are omitted in the following description.

In the cleaner-less configuration, a blade abutting on the photosensitive drum 1 is not arranged on a portion between the primary transfer portion where the photosensitive drum 1 abuts on the intermediate transfer belt 10 and a position where the photosensitive drum 1 abuts on the charging roller 2 serving as a charging member. Accordingly, toner remaining in the photosensitive drum 1 after passing through the primary transfer portion passes through a charging portion where the charging roller 2 abuts on the photosensitive drum 1, so as to be collected by the development unit 4 at a position where the development roller 42 abuts on the photosensitive drum 1.

In a case where the above-described cleaner-less configuration is to be employed, the drum cleaning unit 5 described in the first exemplary embodiment does not have to be arranged on each of the image forming units a to d, so that a space used for the waste toner container can be omitted. With this configuration, a distance between each of the image forming units a to d can be shortened, and downsizing of the image forming apparatus 200 can be achieved. Further, by shortening the distance between each of the image forming units a to d, usability thereof can be improved by shortening the FPOT. In addition, in the present exemplary embodiment, the distance W between each of the photosensitive drums 1*a* to 1*d* is 50 mm.

<Collection of End-Portion Toner Formed in Development Unit>

A configuration of the development unit 4 in the present exemplary embodiment is similar to that of the first exemplary embodiment. In the cleaner-less configuration, the end-portion toner that has moved to the photosensitive drum 1 from the region N of the development roller 42 reaches the primary transfer portion where the photosensitive drum 1 is in contact with the intermediate transfer belt 10 along with rotation of the photosensitive drum 1. At this time, if the end-portion toner remains in the photosensitive drum 1 without being transferred to the intermediate transfer belt 10, the end-portion toner reaches the charging portion where the charging roller 2 abuts on the photosensitive drum 1 along with rotation of the photosensitive drum 1.

There is a risk in that the end-portion toner that has reached the charging portion may move to the charging roller 2 from the photosensitive drum 1 to cause contamination of the charging roller 2. If the toner is adhered to the charging roller 2, an image defect caused by a charging defect may occur because the charging roller 2 cannot charge the photosensitive drum 1 sufficiently. Specifically, because an amount of end-portion toner is greater than an amount of primary transfer residual toner remaining in the primary transfer portion after primary transfer processing, an image defect caused by contamination of the charging roller 2 is likely to occur.

Even in the cleaner-less configuration described in the present exemplary embodiment, an effect similar to that of the first exemplary embodiment can be also acquired by setting a longitudinal width F of the inner surface layer 10*b* and a longitudinal width C of the development opening portion 46 which satisfy the relationship illustrated in FIGS. 6 and 7. In other words, if the end-portion toner formed in the region N of the development roller 42 moves to the photosensitive drum 1, the end-portion toner can be transferred to the intermediate transfer belt 10 from the photosensitive drum 1 at the primary transfer portion and collected by the belt cleaning unit 16. With this configuration, the charging roller 2 is suppressed from being contaminated with the end-portion toner, and thus an image defect caused by a charging defect can be suppressed.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-251837, filed Dec. 26, 2016, which is hereby incorporated by reference herein in its entirety.

What is claimed is:

1. An image forming apparatus comprising:

an image bearing member configured to bear a toner image;

a rotatable endless intermediate transfer belt having electrical conductivity and configured to be in contact with the image bearing member;

a current supply member configured to be in contact with the intermediate transfer belt to supply electric current to the intermediate transfer belt, wherein electric current supplied from the current supply member flows in a circumferential direction of the intermediate transfer belt to cause a toner image to be primarily transferred onto the intermediate transfer belt from the image bearing member;

a power source configured to apply voltage to the current supply member; and a development unit including a development container for containing toner, an opening portion arranged on the development container, a development member for bearing toner contained in the development container, and configured to develop a toner image on the image bearing member in such a manner that the development member bearing toner supplied from the development container abuts on the image bearing member, a sealing member arranged on an inner face of a side wall of the development container to overlap with the development member in a width direction of the intermediate transfer belt orthogonal to the circumferential direction, and a toner supply member which abuts on the development member to supply toner to the development member, wherein the toner supply member is shorter than the development member in the width direction, and an empty space is formed between each of the end portions of the toner supply member and a corresponding one of the end portions of the sealing member, and wherein the intermediate transfer belt includes a plurality of layers including a first layer and a second layer, the first layer being a layer thickest among the plurality of layers in a thickness direction of the intermediate transfer belt, the second layer having electric resistance lower than electric resistance of the first layer and being formed at a position further away from the image bearing member than the first layer in the thickness direction, and both end portions of the second layer are positioned outside of both end portions of the opening portion in the width direction.

2. The image forming apparatus according to claim 1, wherein toner supplied from the development container forms end-portion toner in a region on the development member corresponding to the empty space.

3. The image forming apparatus according to claim 2, further comprising:

a cleaning unit arranged on a downstream side of a position where the current supply member is in contact with the intermediate transfer belt in a moving direction of the intermediate transfer belt, configured to collect toner borne by the intermediate transfer belt, wherein, in a case where the end-portion toner moves to the image bearing member from the development member, the end-portion toner is transferred to the intermediate transfer belt from the image bearing member by electric current flowing in the second layer at a position where the image bearing member is in contact with the intermediate transfer belt, and the end-portion toner transferred to the intermediate transfer belt is collected by the cleaning unit.

4. The image forming apparatus according to claim 3, wherein the cleaning unit includes a blade abutting on the intermediate transfer belt, and the end-portion toner is collected to the cleaning unit at a position where the blade abuts on the intermediate transfer belt.

5. The image forming apparatus according to claim 1, wherein toner remaining on the image bearing member after a toner image is transferred to the intermediate transfer belt from the image bearing member is collected by the development unit.

6. The image forming apparatus according to claim 5, further comprising:

a charging member configured to abut on the image bearing member to charge the image bearing member, wherein a blade for collecting toner by abutting on the image bearing member is not arranged at a position between a position where the image bearing member is in contact with the intermediate transfer belt and a position where the image bearing member abuts on the charging member in a rotation direction of the image bearing member.

7. The image forming apparatus according to claim 1, wherein the first layer has ionic conductivity.

8. The image forming apparatus according to claim 7, wherein the second layer thinner than the first layer is formed on an inner side of the first layer in a thickness direction of the intermediate transfer belt.

9. The image forming apparatus according to claim 1, wherein the first layer is in contact with the image bearing member.

10. The image forming apparatus according to claim 1, wherein the intermediate transfer belt includes a third layer having electric resistance higher than electric resistance of the first layer, and the third layer is in contact with the image bearing member.

11. The image forming apparatus according to claim 10, wherein the third layer has electronic conductivity and has a thickness thinner than a thickness of the first layer.

12. The image forming apparatus according to claim 1, wherein the second layer has electronic conductivity.

13. The image forming apparatus according to claim 1, further comprising a counter member configured to face the current supply member via the intermediate transfer belt, wherein the counter member is in contact with the second layer.

14. The image forming apparatus according to claim 13, wherein the current supply member supplies electric current to the counter member, so that a toner image is primarily transferred to the intermediate transfer belt from the image bearing member, and the toner image primarily transferred to the intermediate transfer belt is secondarily transferred to a transfer material.

15. The image forming apparatus according to claim 13, further comprising a constant voltage element capable of maintaining a predetermined voltage by receiving electric current from the counter member, wherein one end of the constant voltage element is connected to a ground whereas another end of the constant voltage element is connected to the counter member.

16. The image forming apparatus according to claim 15, wherein the constant voltage element is a Zener diode.

17. An image forming apparatus comprising:

an image bearing member configured to bear a toner image;

a rotatable endless intermediate transfer belt having electrical conductivity and configured to be in contact with the image bearing member;

a current supply member configured to be in contact with the intermediate transfer belt to supply electric current to the intermediate transfer belt, wherein electric current supplied from the current supply member flows in a circumferential direction of the intermediate transfer belt to cause a toner image to be primarily transferred onto the intermediate transfer belt from the image bearing member;

a power source configured to apply voltage to the current supply member; and a development unit including a development container for containing toner, an opening portion arranged on the development container, a development member for bearing toner contained in the development container, and configured to develop a toner image on the image bearing member in such a manner that the development member bearing toner supplied from the development container abuts on the image bearing member, a sealing member arranged on an inner face of a side wall of the development container to overlap with the development member in a width direction of the intermediate transfer belt orthogonal to the circumferential direction, and a toner supply member which abuts on the development member to supply toner to the development member, wherein the toner supply member is shorter than the development member in the width direction, and an empty space is formed between each of the end portions of the toner supply member and a corresponding one of the end portions of the sealing member, and wherein the intermediate transfer belt includes a plurality of layers including a first layer and a second layer, the first layer being a layer thickest among the plurality of layers in a thickness direction of the intermediate transfer belt, the second layer having electric resistance lower than electric resistance of the first layer and being formed at a position further away from the image bearing member than the first layer in the thickness direction, and the empty space is arranged between the both end portions of the second layer in the width direction of the intermediate transfer belt orthogonal to the circumferential direction.

* * * * *